US007021988B2

(12) United States Patent
Patton

(10) Patent No.: US 7,021,988 B2
(45) Date of Patent: Apr. 4, 2006

(54) EXPRESSIVE FEATURE MECHANISM FOR ANIMATED CHARACTERS AND DEVICES

(75) Inventor: Brian L. Patton, Ewing, NJ (US)

(73) Assignee: Thin Air Creations, LLC, Ewing, NJ (US)

( * ) Notice: Subject to any disclaimer, the term of this patent is extended or adjusted under 35 U.S.C. 154(b) by 0 days.

(21) Appl. No.: 10/508,787

(22) PCT Filed: May 14, 2003

(86) PCT No.: PCT/US03/15120

§ 371 (c)(1),
(2), (4) Date: Sep. 23, 2004

(87) PCT Pub. No.: WO03/015120

PCT Pub. Date: Dec. 4, 2003

(65) Prior Publication Data

US 2005/0164599 A1 Jul. 28, 2005

Related U.S. Application Data

(60) Provisional application No. 60/381,722, filed on May 17, 2002.

(51) Int. Cl.
*A63H 13/02* (2006.01)

(52) U.S. Cl. ..... 446/337; 446/395

(58) Field of Classification Search ..... 446/190, 446/340, 301, 297, 298, 337, 330, 395, 175, 446/300, 329, 352–354, 391
See application file for complete search history.

(56) References Cited

U.S. PATENT DOCUMENTS

| | | | | |
|---|---|---|---|---|
| 2,250,916 | A | 7/1941 | Magruder | |
| 3,828,469 | A * | 8/1974 | Giroud | 446/337 |
| 3,841,020 | A | 10/1974 | Ryan et al. | |
| 4,177,589 | A | 12/1979 | Villa | |
| 4,294,033 | A * | 10/1981 | Terzian | 446/190 |
| 4,805,328 | A | 2/1989 | Mirahem | |
| 4,808,142 | A | 2/1989 | Berliner | |
| 5,376,040 | A * | 12/1994 | Hickman et al. | 446/329 |
| 6,352,464 | B1 * | 3/2002 | Madland et al. | 446/337 |
| 6,386,942 | B1 * | 5/2002 | Tang | 446/301 |
| 6,503,123 | B1 | 1/2003 | Chung | |
| 6,544,098 | B1 | 4/2003 | Hampton | |

* cited by examiner

*Primary Examiner*—Jacob K. Ackun
*Assistant Examiner*—J Williams
(74) *Attorney, Agent, or Firm*—Synnestvedt Lechner & Woodbridge LLP

(57) ABSTRACT

A mechanism for animated characters capable of visually communicating facial expressions is provided. The mechanism (10) has two mesh gears per upper or lower lip (FIG. 1*b*). One gear of each pair is rotated by a single drive (20, 22). Each gear has two guidance devices (60, 62, 56, 58). Rotation of any gear to which the elastomeric material (80) is connected via a guidance device results in the stretch or ability to retract the elastomeric material. Secondary guidance devices (64, 66, 68, 70) on a gear, when in contact with the elastomeric material, cause an inflection or deflection of the elastomeric material. Resulting stretch or bending of the elastomeric material mimics facial expressions.

13 Claims, 13 Drawing Sheets

EXPRESSIVE FEATURE MECHANISM FOR ANIMATED CHARACTERS AND DEVICES

CROSS REFERENCE TO RELATED APPLICATIONS

This application claims the priority of U.S. Provisional Application Ser. No. 60/381,722 entitled "Expressive Feature Mechanism for Animated Characters and Devices" filed on May 17, 2002, and PCT/US03/15120 filed on May 14, 2003, the entire contents and substance of which are hereby incorporated in total by reference.

BACKGROUND OF THE INVENTION

1. Field of the Invention

The present invention relates to a mechanical apparatus used to cause various expressions on the face of an animated character.

2. Description of Related Art

This invention pertains to an expressive feature mechanism used in an animated character. The goal of this invention is to achieve a full range of human-like and recognizable facial expressions. This goal has been addressed by others and has often led to the development of devices used in animated characters that have mouths, which open and close to mimic speaking or sucking. Examples of such work would be U.S. Pat. No. 4,808,142 by Berliner, which has a motor driven mouth actuator to move the mouth between open and closed positions.

U.S. Pat. No. 2,250,916 by Magruder uses electromagnetic coils to animate the upper and lower lip in synchrony to sound.

U.S. Pat. No. 3,841,020 by Ryan employs a complex set of levers and actuators that allow a range of facial expressions connected to the motion of a dolls arms.

U.S. Pat. No. 3,828,469 by Giroud describes a mechanism having two operating rods for moving upper and lower lips.

More recently issued patents describe techniques that allow for a greater control of lip motion. For example, U.S. Pat. No. 6,352,464 by Madland et al. describes a mechanism for an animated character. The Madland Patent describes a facial control system comprising of two lip chains embedded behind two lips. The lip chains are attached at either end as well as at a center portion. By positioning the movable center portion relative to the moveable ends various facial expressions can be achieved, however, the described mechanism does not allow for stretching of the lips as it occurs on human and animal faces.

Other methods such as the one described in U.S. Pat. No. 4,177,589 by Villa demonstrate a pneumatic mechanism to open and close the mouth. This method allows for a rounding of the lips but does not allow for a full range of expression such as a frown or broad smile.

Mechanisms such as U.S. Pat. No. 6,544,098 by Hampton are capable of some recognizable expressions but only with the addition of other actions such as drooping ears or closing eyes.

The current invention comprises a means to make animated characters with complex facial expressions in a minimal component, minimal cost mechanism. With the described invention it is possible to make a full range of motions with a minimum of moving components.

SUMMARY OF INVENTION

Briefly described, the invention comprises of a pair of wheels or meshed gears used to generate human-like expressions. On each wheel or gear there is an attachment point and a device for inflecting or deflecting an elastomeric or flexible material or device. The primary goal of the wheels or gears is to stretch or allow for contraction of the elastomeric or flexible material or device attached to a point along a radius. Meshing of the gears allows for a reduction of drive sources while maintaining bilateral symmetry of motion. Independent wheels allow for asymmetric motion. In a meshed gear mechanism, one gear and its attachment point mirror the other in the pair. If one gear in the pair turns clockwise, the other gear in the pair turns counterclockwise. Since attachment points mirror each other on each gear of a pair, rotation of the pair would either increase or decrease the distance between each attachment point. An elastomeric or flexible material or device encircling the attachment points stretches or contracts as the gears turn. The inflection-deflection devices offer an increase in the recognition of an exaggerated expression produced by the bending of the elastomeric or flexible material or device.

A more rudimentary expressive system can be produced without the bending of the elastomeric or flexible material or device between its attachment points. The elastomeric or flexible material or device can comprise a variety of conformations, ranging from a continuous band to a molded mask hiding and yet attached to the entire mechanism. The transmission of movement from the gears to the elastomeric or flexible material or device may also occur via indirect coupling such as magnetism.

The invention advantageously provides a moving lip mechanism for animated characters or devices that is simple in its design and construction. The device is capable of producing a range of motions in a range of speeds able to simulate a variety of expressions and mouth movements. With the synchronization of sound the device can simulate smooth, realistic vocalization.

This invention will be described further with reference to the following drawings.

DETAILED DESCRIPTION OF THE PREFERRED EMBODIMENT

Figure 1A:
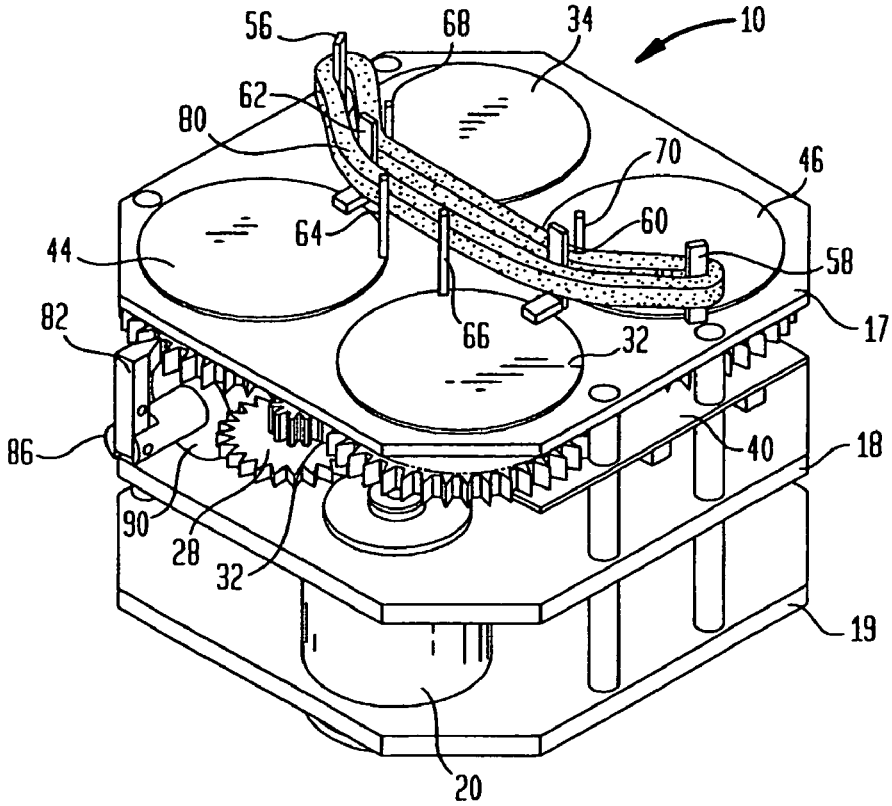
FIG. 1*a* is an isometric view showing a pair of dual gear single drive mechanisms using motors with non-integrated encoding with the elastomeric material in place around attachment points on each of the gears.

During the course of this description, like numbers will be used to identify like elements according to the different views that illustrate the invention.

Referring to FIGS. 1*a*–1*e*, the mechanism 10, according to the preferred embodiment, comprises a lower motor support frame 19, an upper motor support frame 18 and a gear support frame 17. The motor support frames secure two motors 20 and 22, which in turn have small motor drive gears 24 and 26 respectively attached to their perspective drive shafts. Gears 24 and 26 mesh with reduction gears 28 and 30 respectively. The reduced diameters of reduction gears 28 and 30 mesh with primary expression driving gears 32 and 34 respectively. Positional sensing of the primary expression driving gear 32 is achieved by variable resistance or positional contacts on control board 40. It is understood that other commercial means of encoding of position would be equally effective in positional sensing. Magnetic encoding, transmission slots counting, and reflective encoding are examples of other common methods of rotational encoding. Primary expression driving gears 32 and 34 in turn mesh with secondary expression driving gears 44 and 46 respectively. Each expression driving gear has one attachment point and one inflection-deflection pin affixed to a point in relation to the radius of each respective expression driving gear. Each gears attachment point and inflection-deflection pin are at a fixed degree apart from one another. In the case of primary expression driving gear 32, it has attachment point 60 and inflection-deflection pin 66 affixed. In the case of primary expression driving gear 44, it has attachment point 62 and inflection-deflection pin 64 affixed. In the case of primary expression driving gear 34, it has attachment point 56 and inflection-deflection pin 68 affixed. In the case of primary expression driving gear 46, it has attachment point 58 and inflection-deflection pin 70 affixed. Fitted around the four attachment points is elastomeric material 80. To prevent the return rotation of the primary and secondary expression driving gears, gearlocks 82 and 84 fits into the teeth of secondary expression driving gears 44 and 46 respectively. Gearlock 82 is allowed to release secondary expression driving gear 44 by being pulled by solenoid 90 and pivoted on axis 86. Gearlock 84 is allowed to release secondary expression driving gear 44 by being pulled by solenoid 92 and pivoted on axis 88.

FIG. 1*a* of the preferred embodiment illustrates an isometric view of the preferred embodiment of the mechanism 10. In this view, the attachment points 56, 58, 60, and 62 for holding the elastomeric material 80 represent lips, in a smiling expression. As used in this disclosure the term "attachment point" could be a post, a pin or any other projecting means capable of contact with, support of, or attachment to elastomeric material 80. In the preferred embodiment, power to the motors 20 and 22 (see also FIG. 1*b*) is not applied once the desired position is sensed by control board 40. Instead, position is maintained against the pull of elastomeric material 80 by securing against rotation with the gearlocks 82 and 84 (see also FIG. 1*b*). Rotation of the motors and change in expression of 10 as represented by the position of 80 is allowed by the activation of solenoids 90 and 92, see also FIG. 1*b*, and the pull back of respective gearlocks 82 and 84.

Figure 1B:
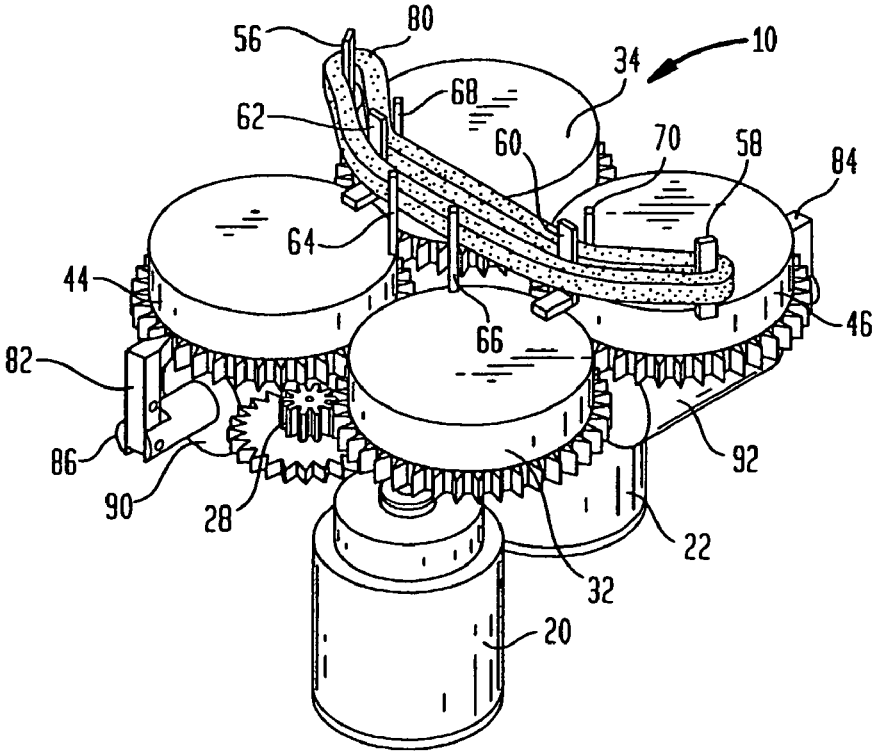
FIG. 1*b* is a support frame removed isometric view showing a pair of dual gear single drive mechanisms using motors with non-integrated encoding with the elastomeric material in place around attachment points on each of the gears.

FIG. 1*b* of the preferred embodiment shows the same isometric view as FIG. 1*a* but with the removal of support frames 17,18,19 and circuit board 40 for clarity, see also FIG. 1*a*.

Figure 1C:
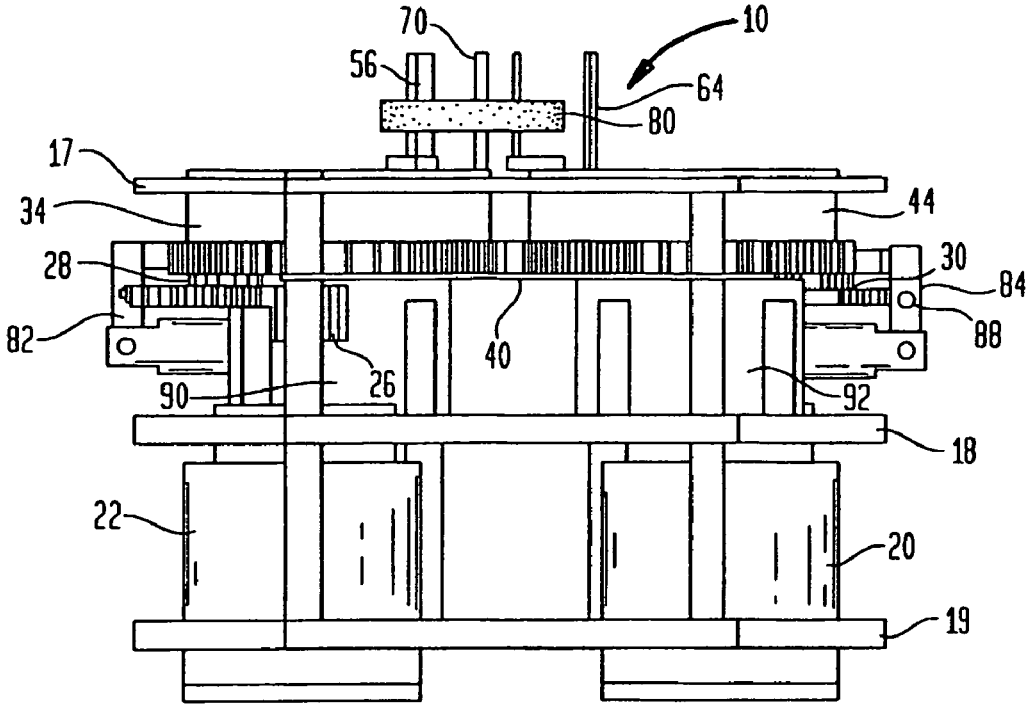
FIG. 1*c*–1*e* are additional views showing a pair of dual gear, single drive mechanisms using motors with non-integrated encoding with the elastomeric material in place around attachment points on each of the gears.
Figure 1D:
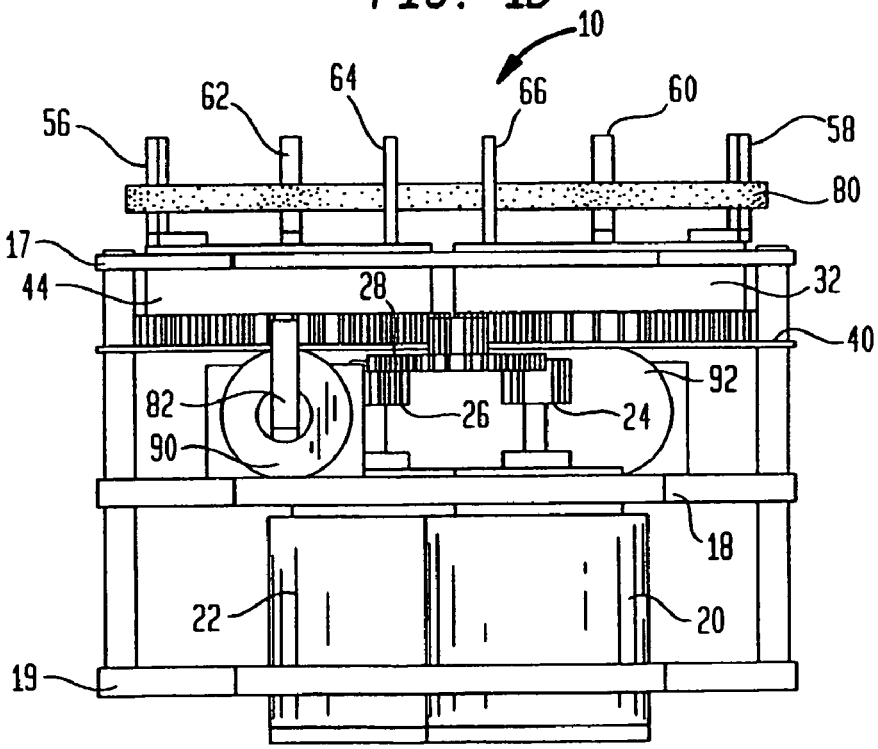

FIG. 1*c* and FIG. 1*d* also describe the preferred embodiment and show a right side and front view of the mechanism 10. These views give clear perspectives of the relative positions of reduction gears 28 and 30 to their meshed small motor drive gears 24 and 26 and primary expression driving gears 32 and 34.

Figure 1E:
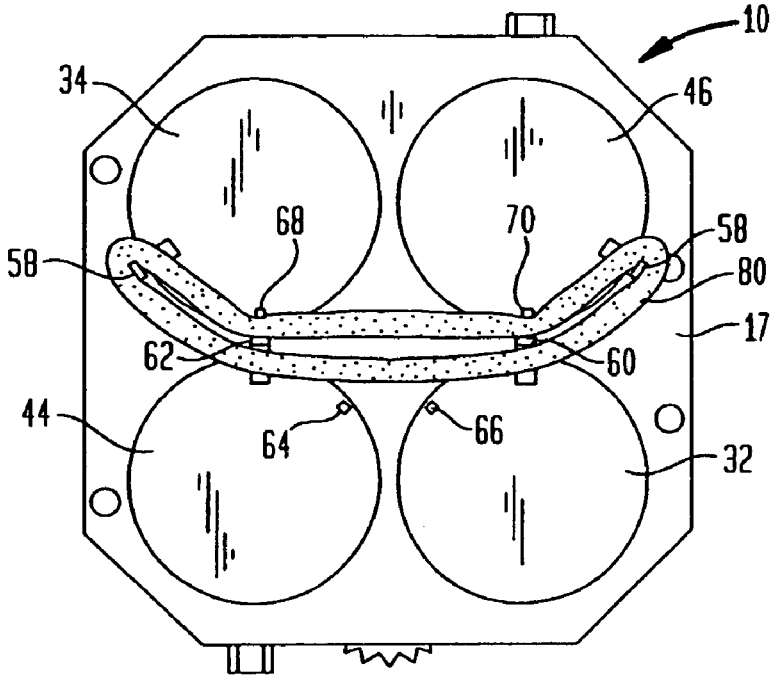

FIG. 1*e* also describing the preferred embodiment illustrates a top view of the mechanism 10. This view would be the side that faces forward and represents the mouth of an animated character or design.

Figure 2:
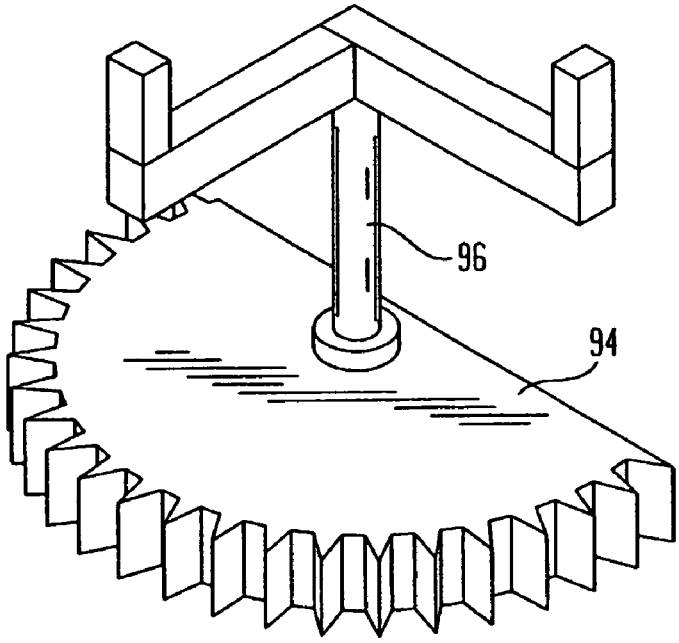
FIG. 2 is an isometric view of an expression driving gear shown with an unused portion of its teeth removed.

FIG. 2 describes an alternate embodiment of either the primary or secondary expression driving gear assemblies. In this figure, the gear 94 has been reduced in dimension to minimize overall construction size. Since only about 180 degrees of rotation is needed to reproduce most recognizable facial expressions, the non-meshed portions of the gear have been cut off. The support arm 94 would preferably be manufactured into a position that fits its need as a primary expression diving gear or secondary expression driving gear.

Figure 3A:
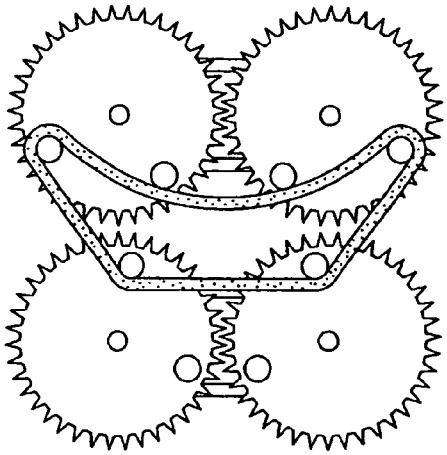
FIG. 3*a*–3*l* are various top views showing the gear arrangement and relative position of the attachment points and inflection-deflection points to present the elastomeric material in an expression.
Figure 3B:
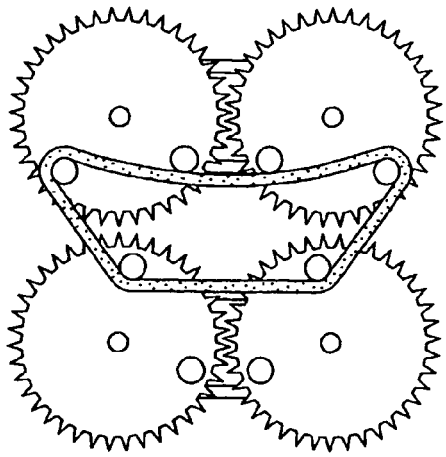
Figure 3C:
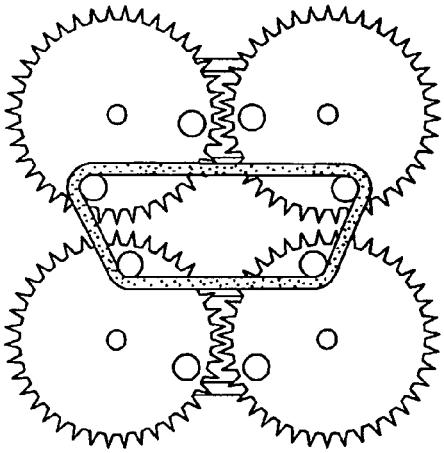
Figure 3D:
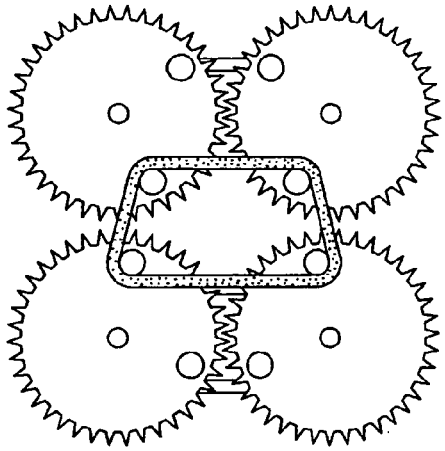
Figure 3E:
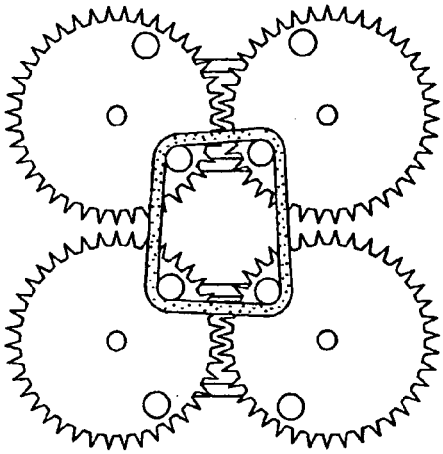
Figure 3F:
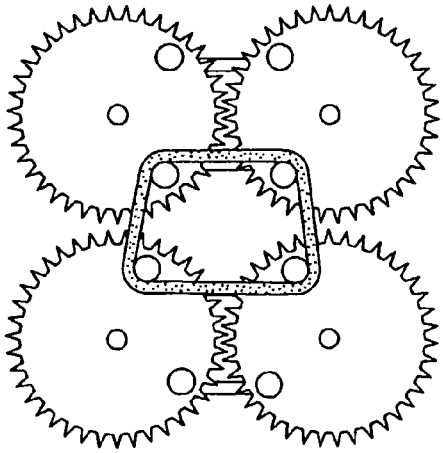
Figure 3G:
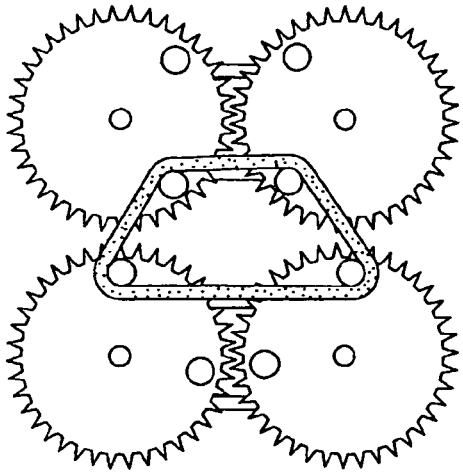
Figure 3H:
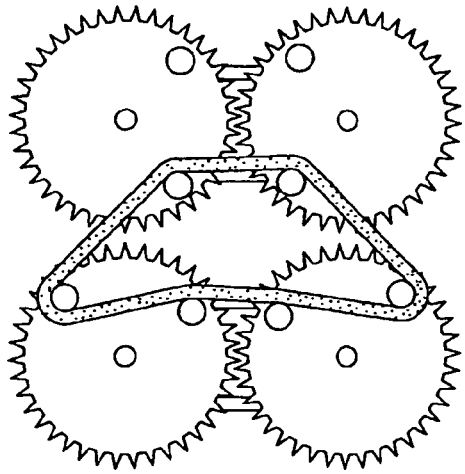
Figure 3I:
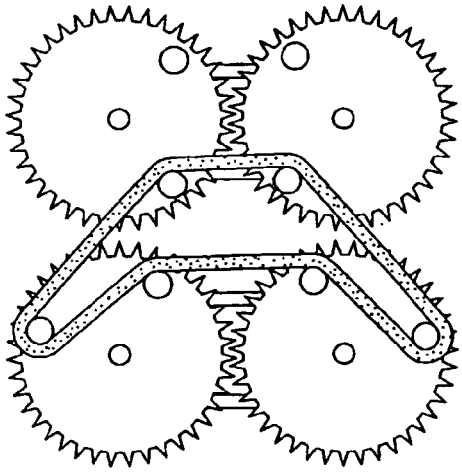
Figure 3J:
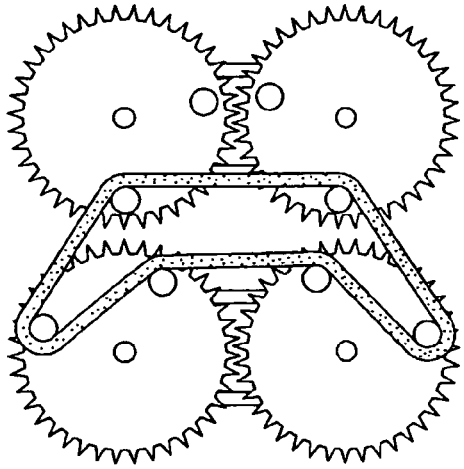
Figure 3K:
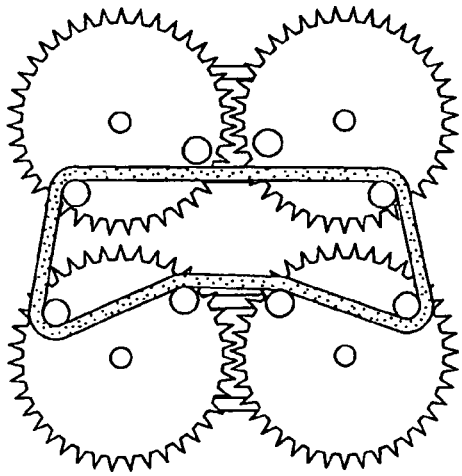
Figure 3L:
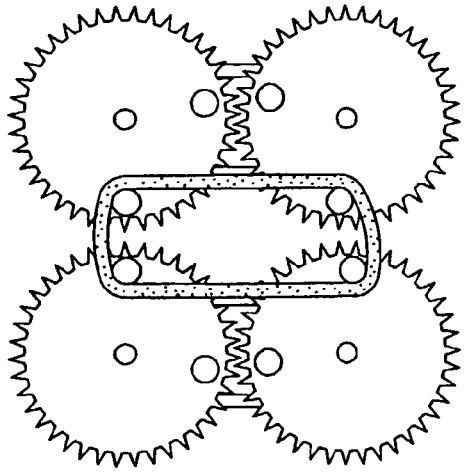

FIGS. 3*a*–3*l* illustrates examples of expression driving gear arrangements and their effect on the elastomeric material stretched around the attachment points. FIG. 3*a*, FIG. 3*b* and FIG. 3*c* show arrangements approximating a smile. FIG. 3*d* to FIG. 3*g* show expressions ranging from surprise to talking intermediates. FIG. 3*h*–FIG. 3*k* shows arrangements emulating sadness and anger. FIG. 3*l* shows the mechanism at rest.

Figure 4A:
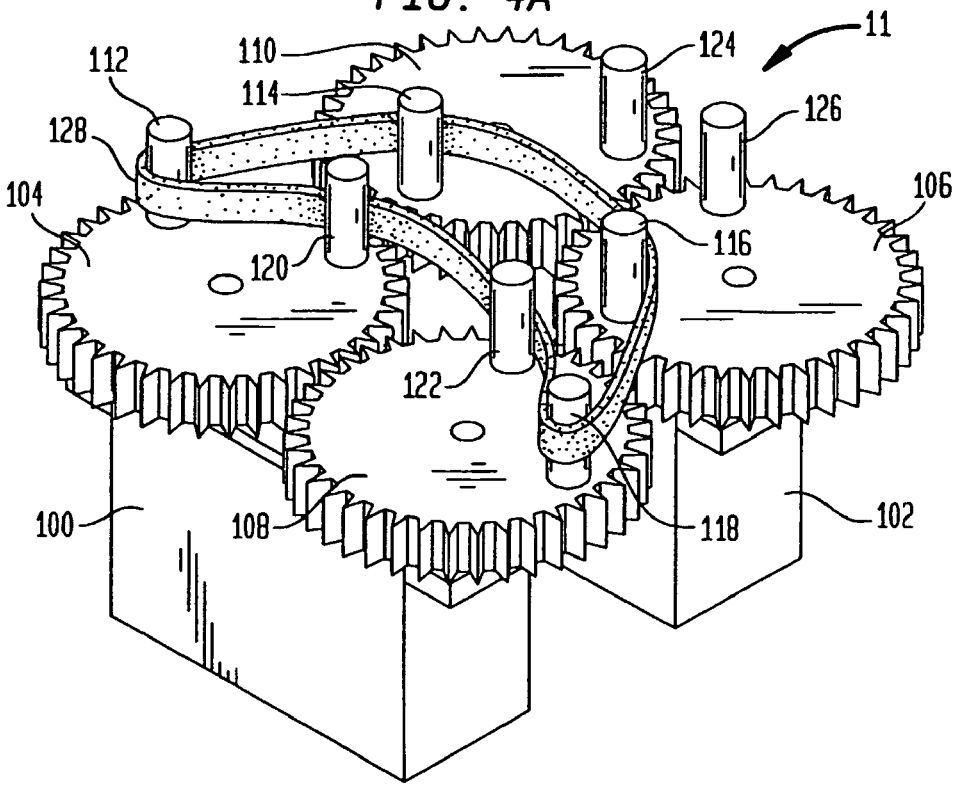
FIG. 4*a*–4*c* are isometric, top and side views respectively of a pair of dual gear, single drive mechanisms with the elastomeric material in place around attachment points on each of the gears.
Figure 4B:
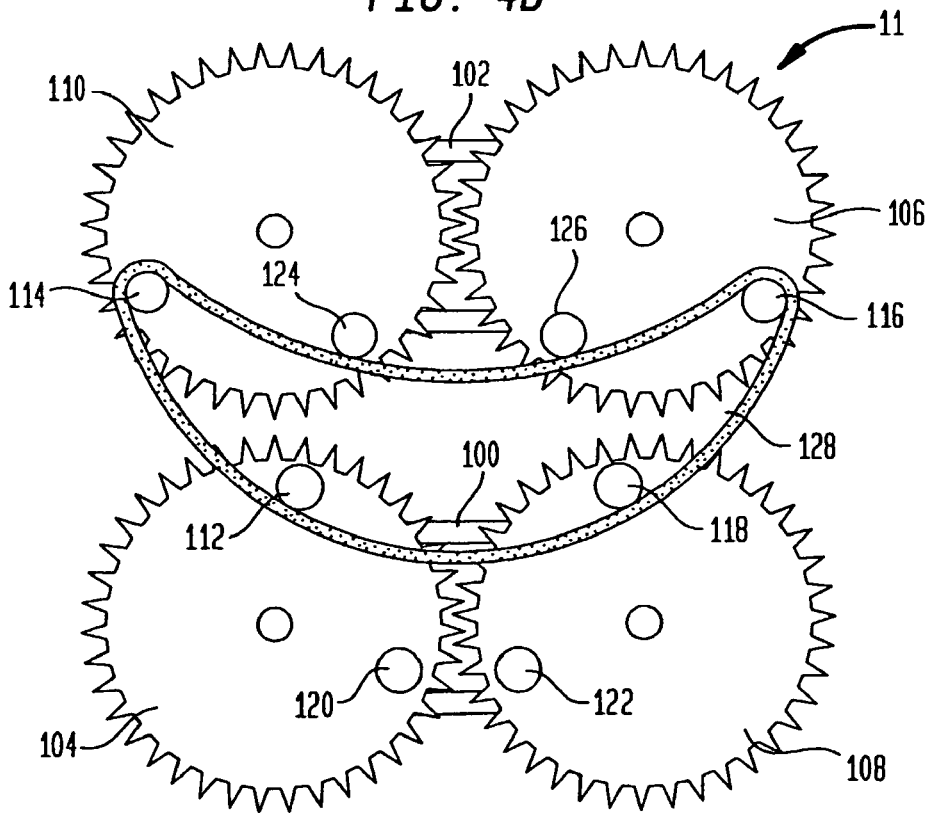
Figure 4C:
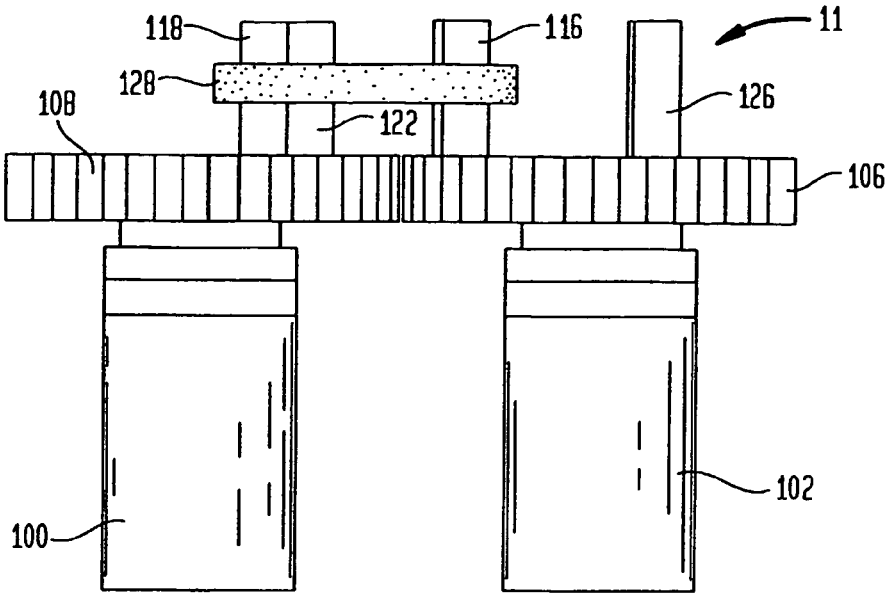

FIGS. 4*a*–4*c* shows an alternate embodiment 11 of the preferred mechanism represented as 10 in FIGS. 1*a*–1*e*. In this embodiment, servo motors 100 and 102 replace the small motors as a means to drive the primary expression driving gears 104 and 106 respectively. This arrangement eliminates the need for a gearlock mechanism since position is maintained for as long as power is applied or until the servo receives instructions to reposition itself. The primary expression driving gears 104 and 106 mesh with secondary expression driving gears respectively. In this embodiment 11, the attachment points 112, 114, 116, and 118 are affixed directly to the expression driving gears 104, 106, 108 and 110.

Referring to isometric FIG. 4*a* and top view FIG. 4*b* which illustrate a pair of dual gear single drive mechanisms, an elastomeric material 128 is placed in position in contact with attachment points 112, 114, 116, and 118. Gears 104 and 106 are attached to servo drives 100 and 102 respectively with integrated gear reduction and positional sensors. As motor drives 100 and 102 rotate, driving their attached gears 104 and 106 respectively, their meshed gears 108 and 112 in turn rotate in the opposite directions. The rotation of the meshed gears results in the radial displacement of the attachment points 112, 114, 116, and 118. As the gears 104, 106, 108, and 110 rotate, the elastomeric material in contact with the attachment points 112, 114, 116, and 118 gets pulled, or is allowed to contract, as the attachment points travel in a path defined by their placement on the gear's radius. In the event that the rotation of the gears 104, 106, 108, and 110 causes the inflection-deflection points 120, 122, 124, and 126 to travel beyond a point defined by a line drawn between the two attachment points 112, 114, 116, and 118, the elastomeric material will be stretched to accommodate the radial movement of the inflection-deflection points 120, 122, 124, and 126.

FIG. 4*c* is a schematic side view of a pair of dual gear single drive mechanisms. Clarity is further enhanced in FIGS. 4*a* and 4*b* by showing the relative positions of the drives 100 and 102, the gears 104, 106, 108, and 110, the attachment points 116 and 118, the inflection-deflection points 122 and 126, and the elastomeric material 128.

Figure 5A:
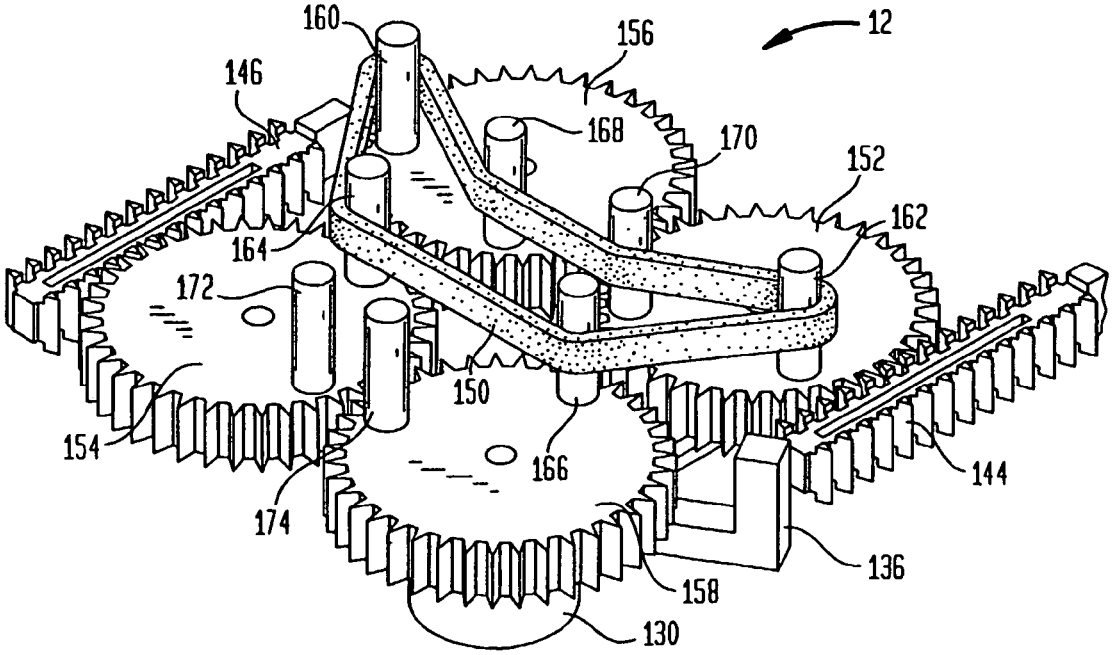
FIG. 5*a*–5*c* are isometric, top and side views respectively of a single drive four gear, rack and pinion mechanisms with the elastomeric material in place around attachment points on each of the gears.
Figure 5B:
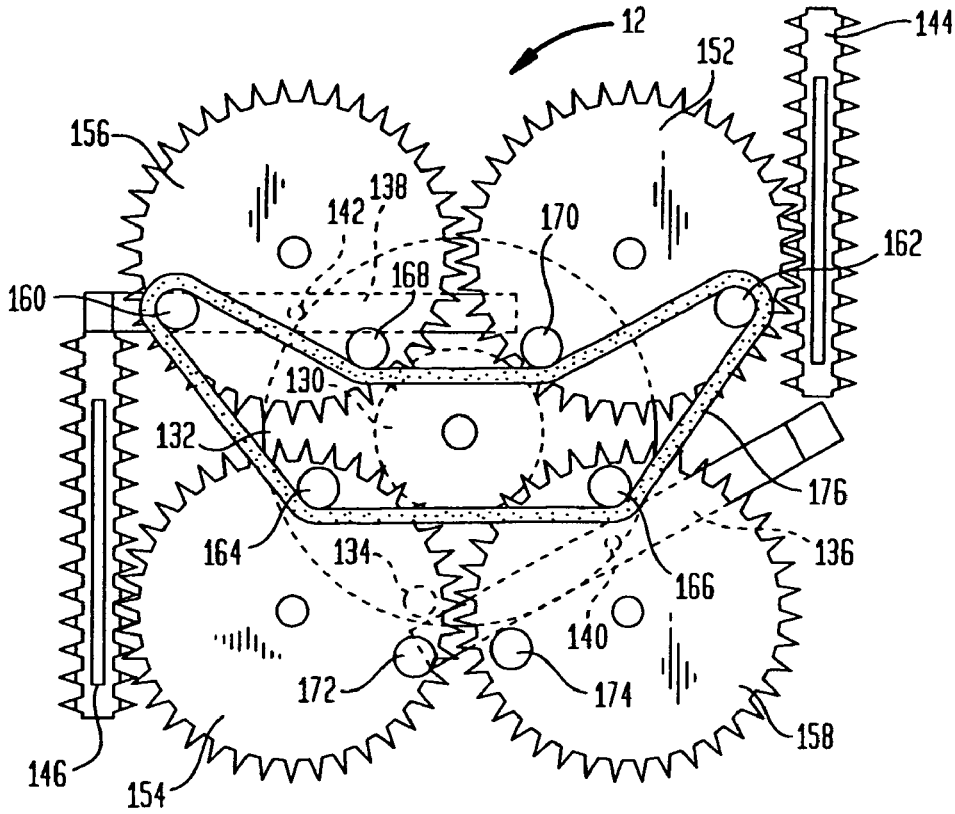

Referring now to isometric FIG. 5*a* and top view FIG. 5*b* of a single drive four gear rack and pinion mechanisms 12, an elastomeric material 150 is placed in position in contact with attachment points 160, 162, 164 and 166. Pinion expression driving gears 152 and 155 are meshed with racks 144 and 146 that can be moved by the action of levers 136 and 138 respectively. Levers 136 and 138 are rotated on their fulcrums 140 and 142 respectively by the force applied by pin 134 as the result of the rotation of wheel 132. As wheel 132 attached motor drive 130 rotates, the displacement of levers 136 and 138 causes the movement of a racks 144 and 146 to rotate its respectively matched pinion expression driving gear 152 and 154. The secondary expression driving gears 156 and 158 rotate in the opposite direction of their meshed primary expression driving gears 152 and 154 respectively. The rotation of the meshed expression driving gears 152, 154, 156 and 158 result in the radial displacement of the attachment points 112, 114, 116, and 118. As the gears rotate, the elastomeric material 150 in contact with the attachment points 112, 114, 116, and 118 gets pulled, or is allowed to contract, as the attachment points travel in a path defined by their placement on the gears radius.

Figure 5C:
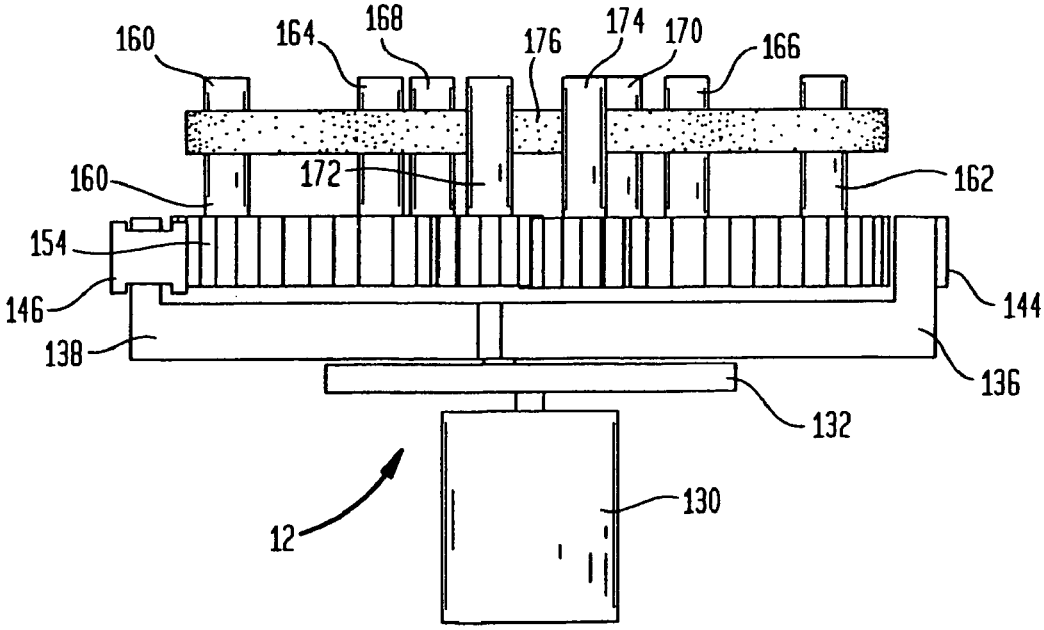

FIG. 5*c* is a schematic side view of a single drive four gear rack and pinion mechanism 12. Clarity is further enhanced from FIG. 5*a* and FIG. 5*b* by showing the relative positions of the drive 130, the wheel 132, levers 136 and 138, racks 144 and 146, the pinion expression driving gear 154, the attachment points 112, 114, 116, and 118, the inflection-deflection points 120, 122, 124, and 126, and the elastomeric material 176.

FIGS. 6*a*, 6*b*, 6*c* and 6*d* illustrate an alternate embodiment 13 of the preferred mechanism represented as 10 in FIGS. 1*a*–1*e*. In this alternative embodiment 13, servo motors 180 and 182 replace the small motors as a means to drive the primary expression driving gears 184 and 186 respectively. This technique eliminates the need for a gearlock mechanism since position is maintained for as long as power is applied or until the servo receives instructions to reposition itself. The primary expression driving gears 184 and 186 mesh with secondary expression driving gears 188 and 190 respectively. In this alternative embodiment 13, the expression driving gears 184, 186, 188 and 190 have their gear teeth set at an angle to allow the gears to rotate on separate planes. By setting the gears at an angle it is possible to better fit the model of a human or animal face, if desired. Attachment points 200, 202, 204 and 206 are affixed to support arms 194, 198, 196 and 192 respectively. Inflection-deflection points 212, 214, 208 and 210 are affixed to support arms 194,198, 196 and 192 respectively. The support arms 192 and 194 are affixed to primary expression driving gears 184 and 186 respectively. The support arms 196 and 198 are affixed to secondary expression driving gears 188 and 190 respectively. An elastomeric material 216 is placed in position in contact with attachment points 200, 202, 204 and 206.

Figure 6A:
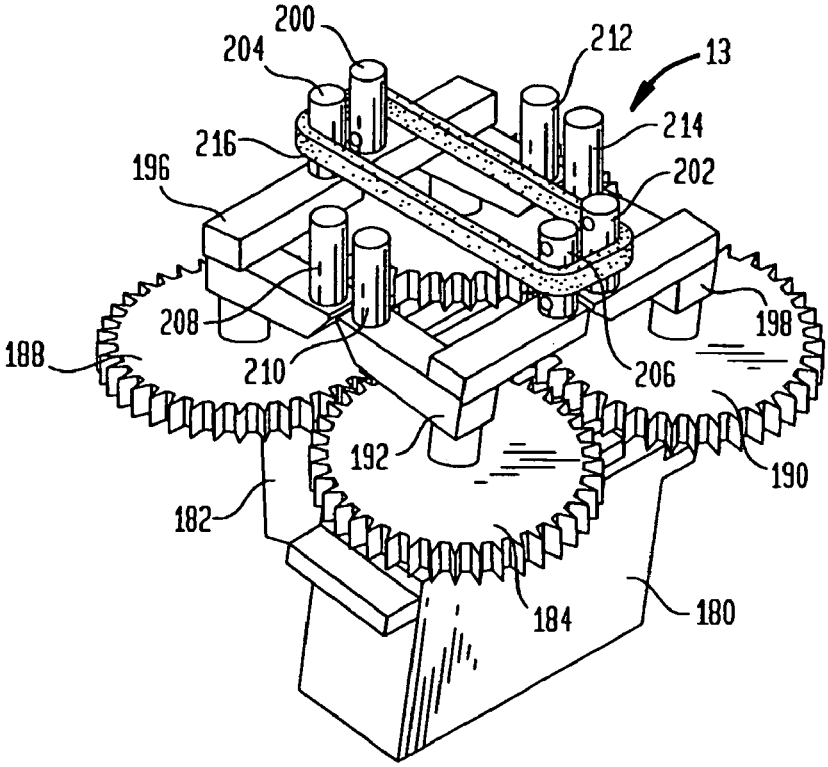
FIG. 6*a* is a isometric view showing a pair of dual gear, single drive mechanisms with an angular offset and the elastomeric material in place around attachment points on each of the gears.

Referring to isometric FIG. 6*a* illustrating a pair of dual gear single drive mechanisms, an elastomeric material 216 is placed in position in contact with attachment points 200, 202, 204 and 206. Primary expression driving gears 184 and 186 are attached to servo drives 180 and 182 respectively with integrated gear reduction and positional sensors. As motor drives 180 and 182 rotate, driving their attached primary expression driving gears 184 and 186 respectively, their meshed secondary expression driving gears 188 and 190 in turn rotate in the opposite direction. The rotation of the expression driving gears 184, 186, 188 and 190 results in the radial displacement of the attachment points 200, 202, 204 and 206. An elastomeric material 216 is placed in position in contact with attachment points 200, 202, 204 and 206. As the expression driving gears 184, 186, 188 and 190 rotate, the elastomeric material 216 in contact with the attachment points 200, 202, 204 and 206 gets pulled, or is allowed, to contract as the attachment points 200, 202, 204 and 206 travel in a path defined by their placement on the expression driving gear's radius. In the event that the rotation of the attachment points 200, 202, 204 and 206 causes the inflection-deflection points 212, 214, 208 and 210 to travel beyond a point defined by a line drawn between two attachment points 200, 202, 204 and 206, the elastomeric material will be stretched to accommodate the radial movement of the inflection-deflection points 212, 214, 208 and 210.

Figure 6B:
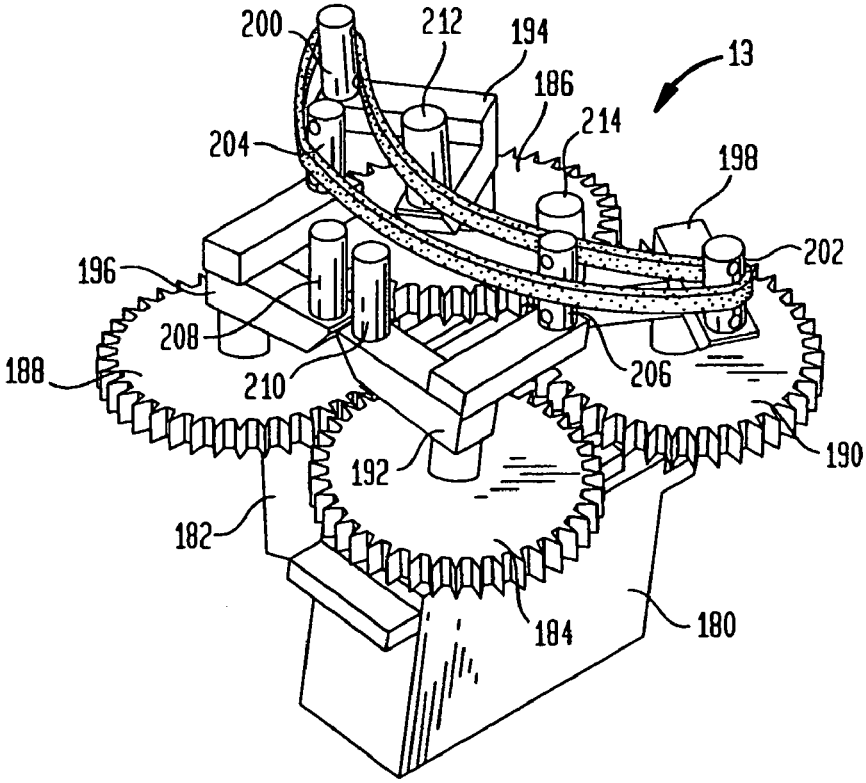
FIG. 6*b* is an isometric view showing a pair of dual gear single drive mechanisms with an angular offset.

FIG. 6*b* is an isometric view of alternative embodiment 13. Primary expression driving gear 186 and meshed secondary expression driving gear 190 are shown rotated so that support arms 194 and 198 present attachment points 200 and 202 in a position that would reflect a smile similar to the one demonstrated in FIG. 3*a*. The inflection-deflection points 212 and 214 then contact the elastomeric material to further stretch the material in the form of a smile.

Figure 6C:
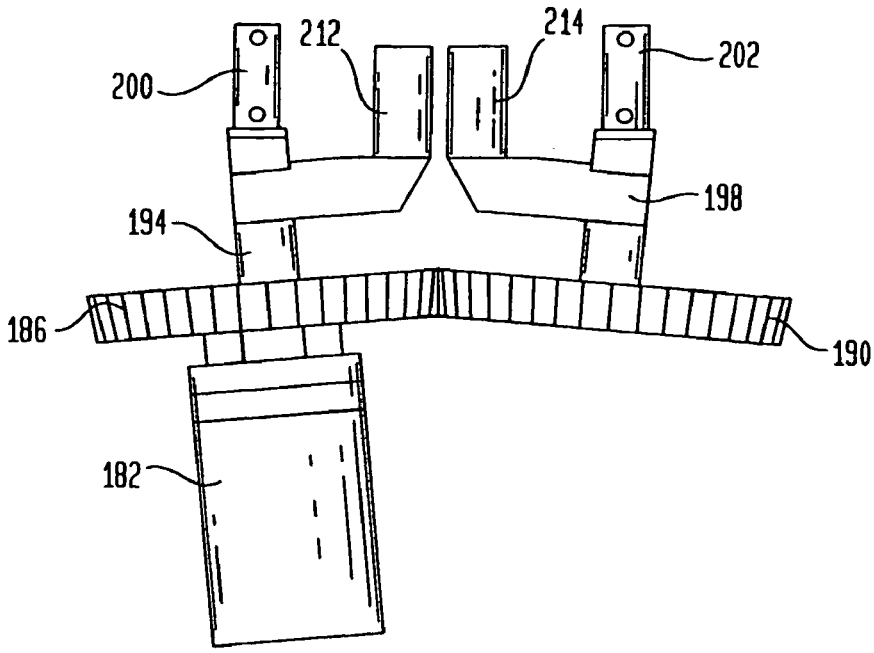
FIG. 6*c* is a front view showing a single dual gear, single drive mechanism with an angular offset.

FIG. 6*c* is a side view of one servo drive 182 and one meshed pair of expression driving gears 186 and 190. Removal of one drive and a meshed gear pair adds clarity to the view of how angular displacement of the expression driving gears 186 and 190 is achieved. The relative position of support arms 194 and 198 as well as attachment points 200 and 202 and inflection-deflection points 212 and 214 is visible.

Figure 6D:
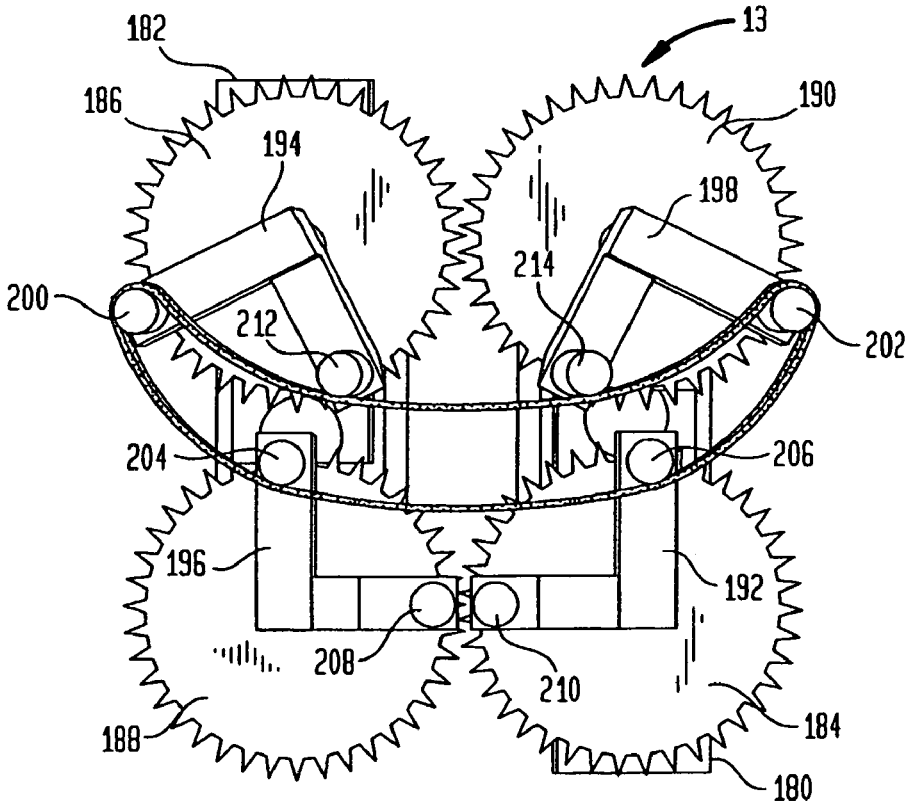
FIG. 6*d*–6*e* are top and side views respectively showing a pair of dual gear, single drive mechanisms with an angular offset.
Figure 6E:
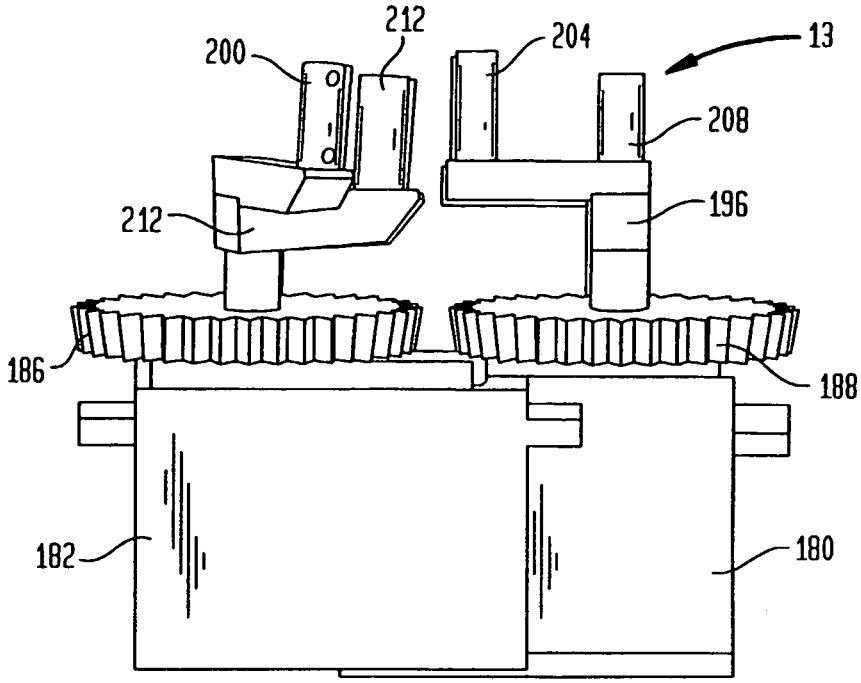

FIG. 6*d* and FIG. 6*e* are top and side views, respectively, of alternative embodiment 13. Primary expression driving gear 186 and meshed secondary expression driving gear 190 are shown rotated so that support arms 194 and 198 present attachment points 200 and 202 in a position that would reflect a smile similar to the one demonstrated in FIG. 3*a*. The inflection-deflection points 212 and 214 then contact the elastomeric material to further stretch the material in the form of a smile.

Referring to FIGS. 7*a*–7*d*, the mechanism 14 further comprises of a lower motor support frame 234, an upper motor support frame 232, and a gear support frame 230. The motor support frames secures one motor 236, which in turn has a small motor drive gear 238 attached to the drive shaft. Gear 238 meshes with reduction gear 240. The reduced diameter of reduction gear 240 meshes with primary expression driving gear 244. Positional sensing of the primary expression driving gear 244 is achieved by variable resistance or positional contacts on control board 246. It is understood that other commercial means of encoding of position would be equally effective in positional sensing. Magnetic encoding, transmission slots counting, and reflective encoding are examples of other common methods of rotational encoding. Primary expression driving gear 244 in turn meshes with secondary expression driving gear 242. Each expression driving gear has one attachment pin and one inflection-deflection pin affixed to a point in relation to the radius of each support arm's respective expression driving gears at a fixed degree apart from one another. In the case of primary expression driving gears 242, it has attachment point 252 and inflection-deflection pin 262 affixed. In the case of primary expression driving gear 244, it has attachment point 254 and inflection-deflection pin 260 affixed. Attachment points 256 and 258 are fixed to an immobile point in such a way as to allow for attachment of elastomeric material 264. Fitted around the four attachment points is elastomeric material 264. To prevent the return rotation of the primary and secondary expression driving gears, gearlock 248 fits into the teeth of secondary expression driving gear 244. Gearlock 248 is allowed to release secondary expression driving gear 244 by being pulled by solenoid 250 and pivoting around an axis.

Figure 7A:
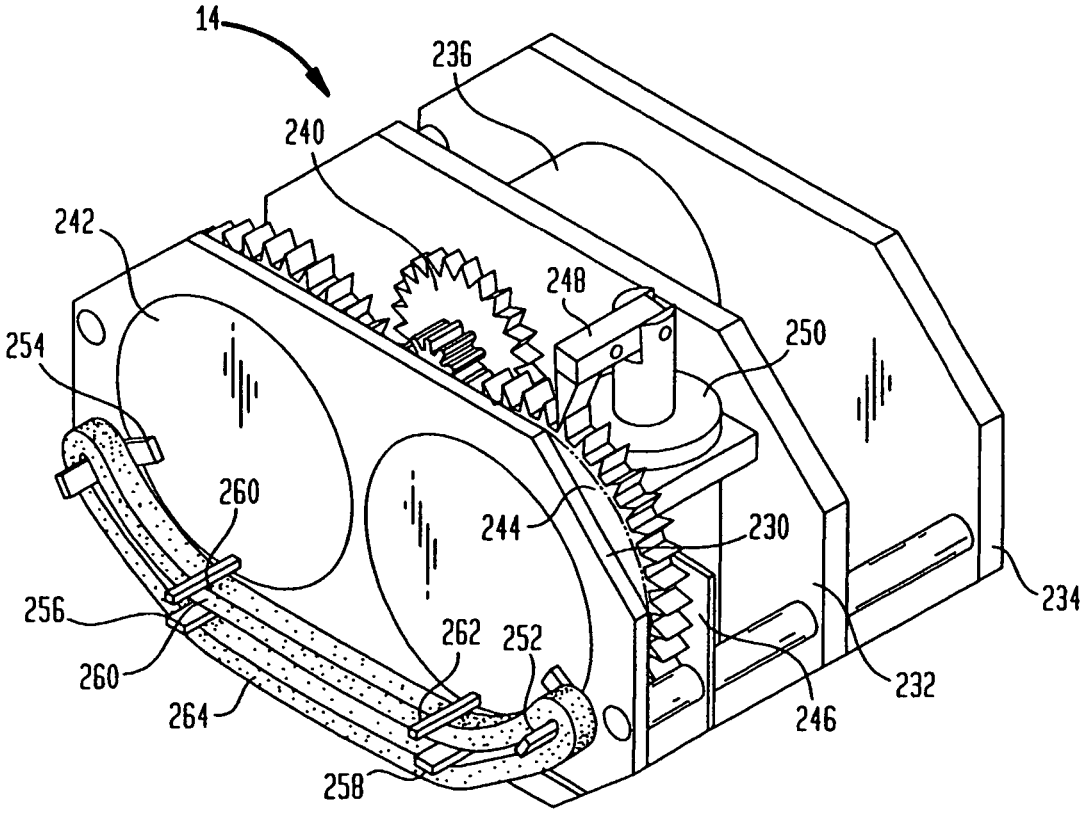
FIG. 7*a*–7*d* are isometric, front, side and top views respectively of a single drive, two gear, mechanism with the elastomeric material in place around attachment points on each of the gears and fixed points on the mechanisms frame.

FIG. 7*a* is an isometric view of the of the mechanism 14. In this view, the attachment points 252,254,256, and 258 are shown holding the elastomeric material 264, representing lips, in a smiling expression. In this embodiment, power to the motor 236 is not applied once the position is sensed by control board 246. Instead, position is maintained against the pull of elastomeric material 264 by securing against rotation with the gear lock 248. Rotation of the motor and thus change in expression of 14 as represented by the position of 264 is effected by the activation of solenoid 250 and the pull back of gearlock 248.

Figure 7B:
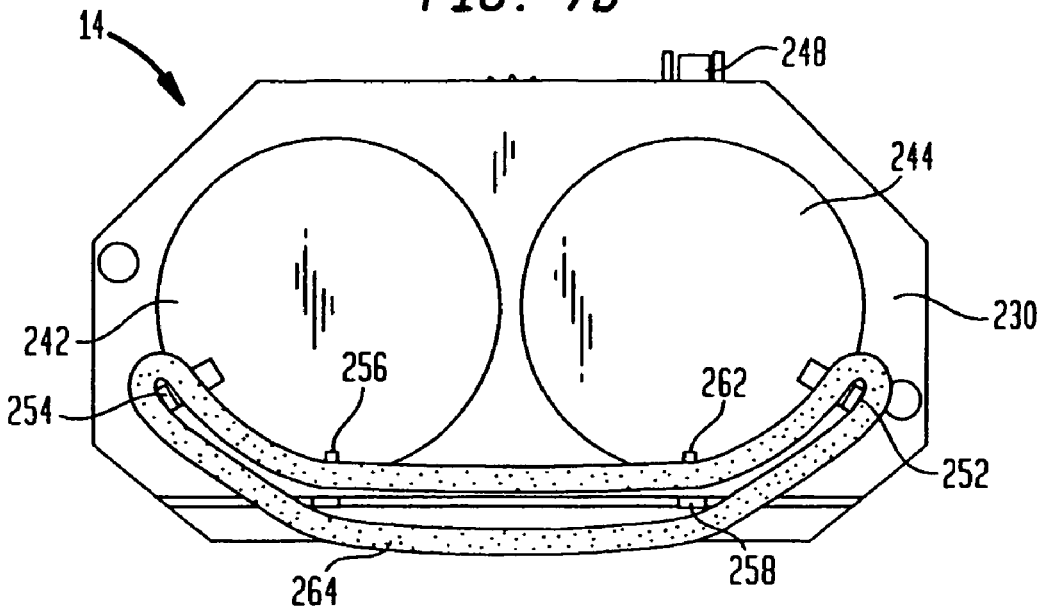

FIG. 7*b* of this embodiment illustrates a top view of the mechanism 14. This view would be the side that faces forward and represents the mouth of an animated character or design.

Figure 7C:
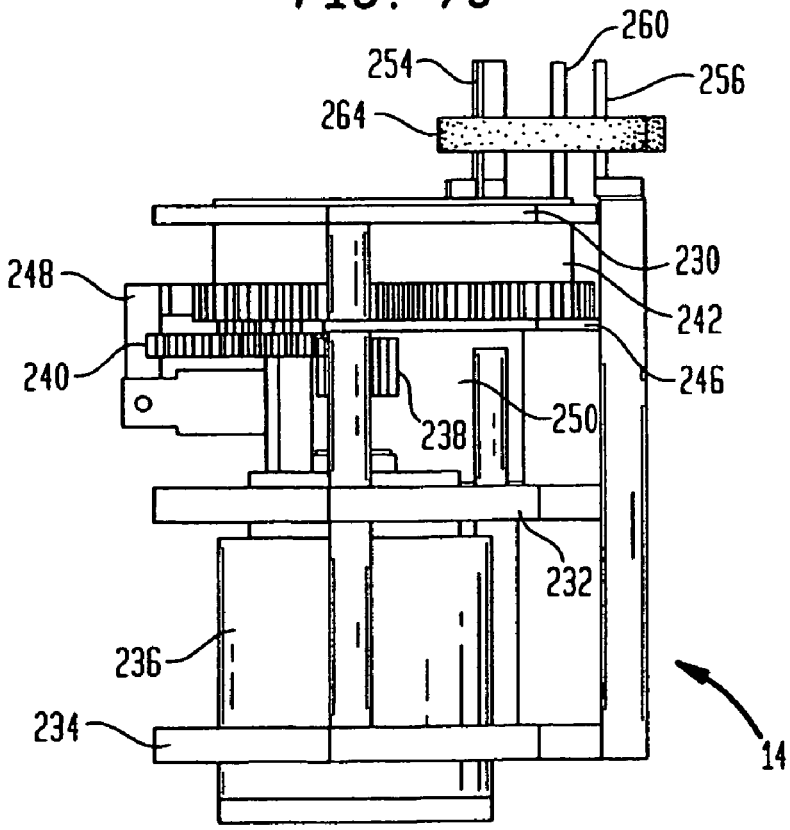
Figure 7D:
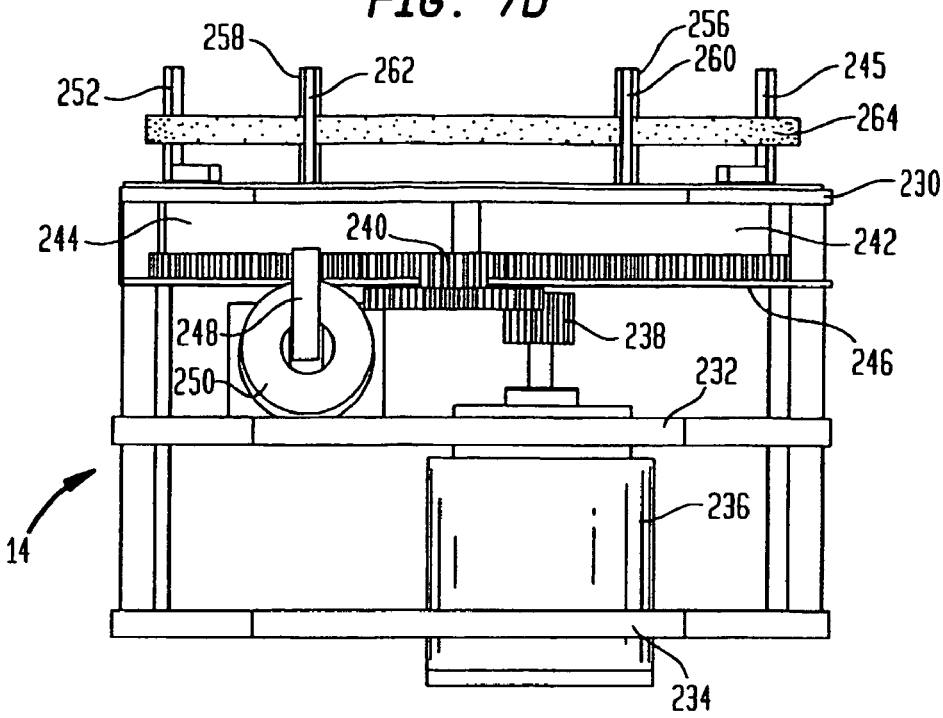

FIG. 7*c* and FIG. 7*d* of this embodiment show a side and top view of the mechanism 14. These views give clear perspectives of the relative position of reduction gear 240 to its meshed small motor drive gear 238 and primary expression driving gear 244.

Figure 8:
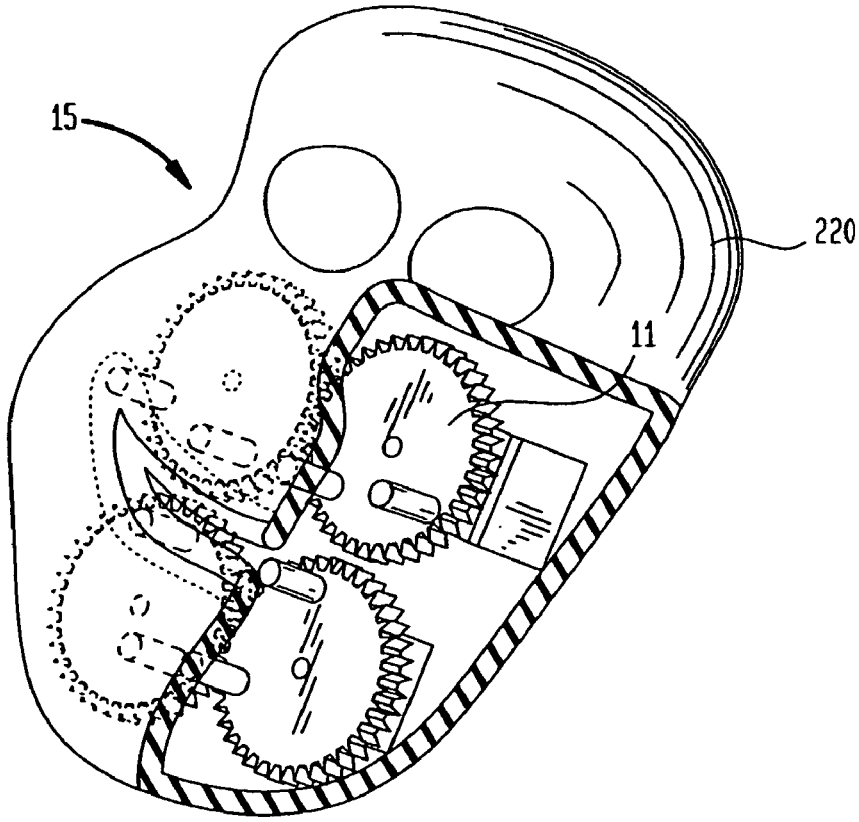
FIG. 8 is an isometric view showing a pair of dual gear, single drive mechanisms with the elastomeric material being represented as a flexible mask in place around attachment points on each of the gears.

FIG. 8 is a completed unit 15 illustrating placement of an elastomeric mask 220 around a pair of dual gear single drive mechanisms 11 as represented in FIG. 4*a*. In this figure the inflection-deflection points engage ridges or grooves embedded in the material of the mask's construction. Accordingly, the invention can include an elastomeric material which is either a circle with a hole therein, or wherein the attachment points and inflection-deflection pins touch the elastomeric material or engage ridges therein, or which the hole may be alternatively comprised of continuous elastomeric membrane material surrounded by elastic lip sections.

While the invention has been described with reference to the preferred embodiment thereof it will be appreciated by those of ordinary skill in the art that modifications can e made to the parts that comprise the invention without departing from the spirit and scope thereof.

The invention claimed is:

1. An apparatus for mimicking human expressions comprising:

a first rotatable means having an attachment point thereon;

an inflection-deflection pin located on said first rotatable means;

a second rotatable means also having an attachment point thereon;

an inflection-deflection pin located on said second rotatable means, wherein said second rotatable means is driveably connected to said first rotatable means so that said first and second rotatable means rotate simultaneously;

an elastic means attachable to said attachment point on said first and second rotatable means; and, a drive means for driving at least one of said rotatable means, wherein said first and second rotatable means rotate in opposite directions and wherein said first and second rotatable means causes said elastic means to assume forms suggestive of human expression and, further, wherein said inflection-deflection pins contact said elastic means when said first and second rotatable means rotate in order to deform said elastic means and make said human expressions more realistic.

2. The apparatus of claim 1 wherein said elastic means comprises a circular elastic means having a hole in the center thereof and said attachment point pass through the hole in center of said circular elastic means.

3. The apparatus of claim 2 wherein said first and second rotatable means comprise gears having teeth that mesh with each other.

4. The apparatus of claim 3 further comprising:

a base, wherein said first and second rotatable means are mounted on said base.

5. The apparatus of claim 4 further comprising:

a third rotatable means having an attachment pin and an inflection-deflection pin mounted thereon, wherein said attachment point also passed through the hole in said center of said circular elastic means.

6. The apparatus of claim 5 further comprising:

a fourth rotatable means having an attachment pin and an inflection-deflection pin mounted thereon, wherein said attachment point also passed through the hole in said center of said circular elastic means.

7. The apparatus of claim 6 further including:

a pair of animated eye simulation means that operate in a coordinated fashion with actuation of said circular elastic means.

8. The apparatus of claim 1 wherein said elastic means comprises:

an elastic material coupled to an attachment point on the upper surface of said first rotatable means and to an attachment point on the upper surface of said second rotatable means such that the elastic material can be deformed by axial rotation of at least one of said rotatable means.

9. The apparatus of claim 1 further comprising:

a base;

a first immovable point means attached to said base for contacting said elastic means, wherein said first immovable point means does not move with respect to said base.

10. The apparatus of claim 9 further comprising:

a second immovable point means also attached to said base for contacting said elastic means, wherein said second immovable point means does not move with respect to said base.

11. The apparatus of claim 1 wherein said attachment point and said inflection-deflection pin on said first rotatable means is spaced apart from said first rotatable means by a first support arm and said attachment pin and said inflection-deflection pin on said second rotatable means is also spaced apart from said second rotatable means by a second support arm.

12. The apparatus of claim 1 wherein said elastic means include a ridge therein for engaging said attachment points and said inflection-deflection pins.

13. The apparatus claim 1 wherein said elastic means includes lip sections for engaging said attachment points and said inflection-deflection pins and an elastic mouth section located between said lip sections.

* * * * *